US005282608A

United States Patent [19]

Duca et al.

[11] Patent Number: 5,282,608

[45] Date of Patent: Feb. 1, 1994

[54] INDUCTION HEATED METAL POURING APPARATUS

[75] Inventors: William J. Duca, Boardman, Ohio; William W. Seaton, Dexter; Thomas E. Wuepper, Alger, both of Mich.; Kenneth D. McKibben, Defiance, Ohio

[73] Assignee: CMI International, Southfield, Mich.

[21] Appl. No.: 985,018

[22] Filed: Dec. 3, 1992

[51] Int. Cl.[5] ..... B22D 41/01

[52] U.S. Cl. ..... 266/237; 266/236; 222/593; 222/602

[58] Field of Search ..... 266/234, 236, 237, 242, 266/275; 373/151; 222/593, 602

[56] References Cited

U.S. PATENT DOCUMENTS

| | | | |
|---|---|---|---|
| 2,648,715 | 8/1953 | Lillenberg | 266/242 |
| 2,937,789 | 5/1960 | Tama | 222/590 |
| 3,483,301 | 12/1969 | Duca | 373/151 |
| 3,579,324 | 5/1971 | Kenedy et al. | 373/151 |
| 3,599,835 | 8/1971 | Kocks | 222/590 |
| 3,602,625 | 8/1971 | Duca | 373/151 |
| 3,764,305 | 10/1973 | Andersson | 266/236 |
| 3,856,183 | 12/1974 | Bauer | 373/151 |
| 3,917,896 | 11/1975 | Nakagawa et al. | 373/151 |
| 4,114,675 | 9/1978 | Buhrer | 164/155 |
| 4,230,308 | 10/1980 | Gueguen | 266/236 |
| 4,557,313 | 12/1985 | Navarre | 164/155 |
| 5,056,692 | 10/1991 | Wilford et al. | 222/590 |

*Primary Examiner*—Scott Kastler

*Attorney, Agent, or Firm*—Reising, Ethington, Barnard, Perry & Milton

[57] ABSTRACT

A pouring ladle (12) includes a horizontal chamber (22) having an inlet (24) at one end thereof for admitting molten metal into the chamber (22) and a bottom-poured nozzle (28) at an opposite end for discharging the metal into an underlying mold (30). A coreless induction heater (56) surrounds the chamber (22) for heating metal as it flows from the inlet (24) to the outlet nozzle (28). The induction heater (56) may be operated simultaneously with the pouring of metal and be used to pour treated ductile iron without plugging the inductor (56).

10 Claims, 2 Drawing Sheets

FIG-1
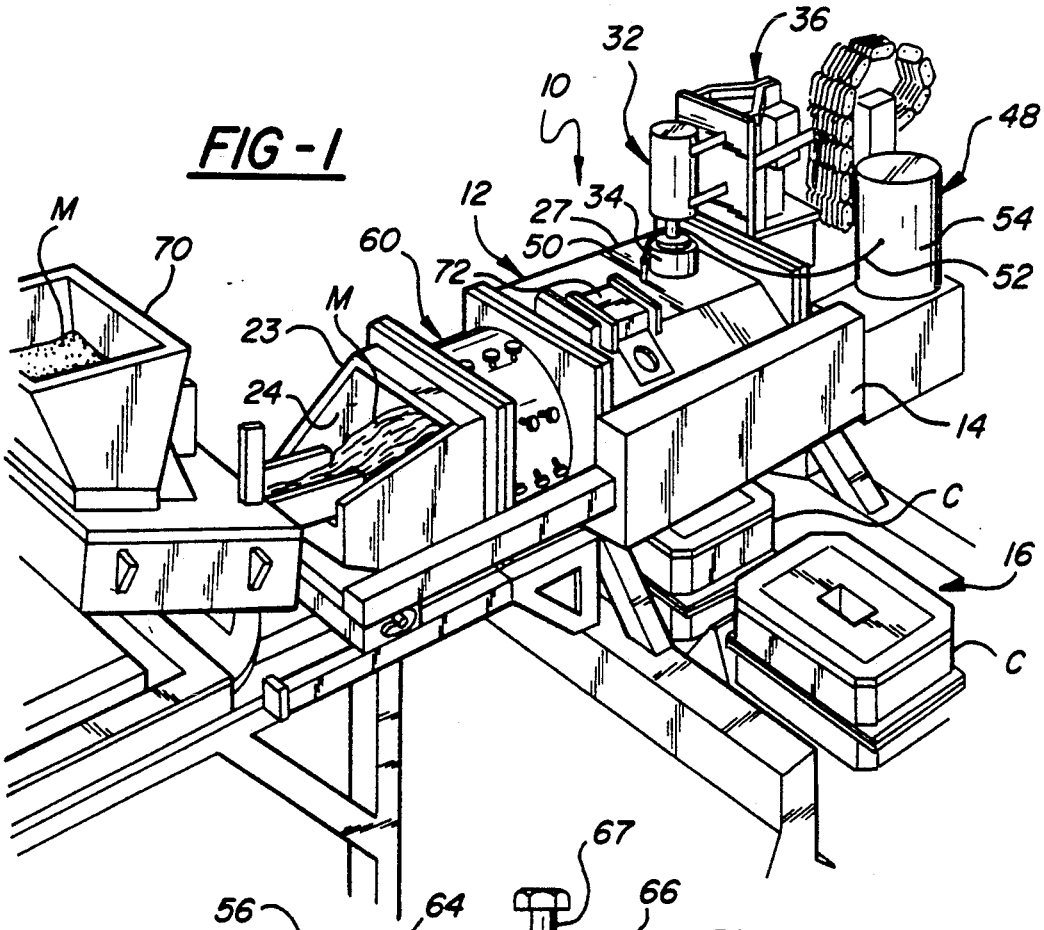
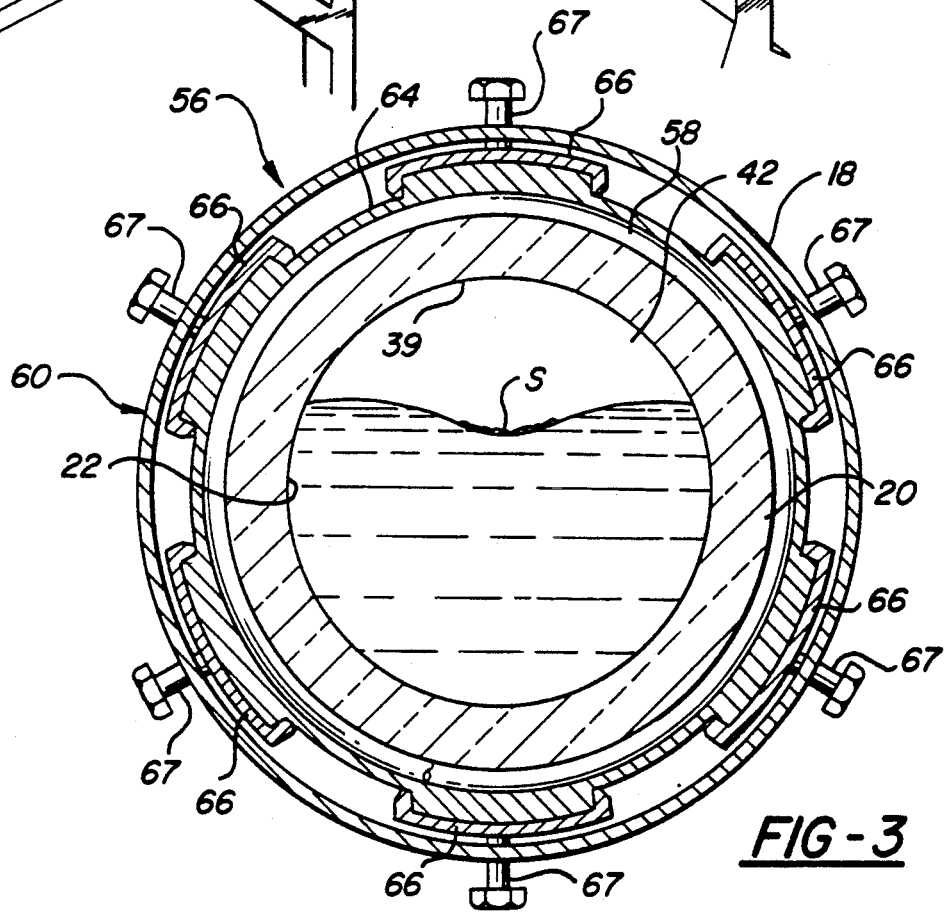
FIG-3

INDUCTION HEATED METAL POURING APPARATUS

BACKGROUND OF THE INVENTION

1. Technical Field

The invention relates generally to a metal pouring apparatus and more particularly to such apparatus equipped with an induction heater.

2. Prior Art

Automated pouring devices have been used for many years to produce metal castings. Such devices typically include a pouring vessel having an inlet for admitting molten metal into a main holding chamber within the vessel and a bottom nozzle outlet for discharging the metal into underlying casting molds. Such vessels are commonly equipped with an automated stopper rod mechanism for regulating the discharge of metal from the nozzle.

The earliest of these pouring vessels was unheated. Consequently, when the metal temperature fell below a minimum pouring temperature, the metal in the ladle had to be pigged or else scrap castings would be produced.

Subsequent pouring vessels were equipped with a cored channel induction heater. The metal in this vessel is heated by withdrawing it from the vessel's main chamber, passing the metal through the induction heated channel for heating and then back into the main chamber for mixture with the remaining metal in the vessel. While this type of heated pouring vessel performs well when pouring most types of ferrous metals, including gray and malleable iron, it is not well suited for pouring magnesium-treated ductile iron, since MgO deposits quickly plug the channel inductor and render it useless. There have been recent efforts by those skilled in the metal pouring industry to overcome the plugging problem, however, most producers of cast ductile iron products have reverted to using unheated pouring vessels.

Various other induction heating arrangements have been proposed as alternatives to channel inductors. One such alternative utilizes a coreless induction coil extending vertically about a bottom poured holding vessel having a vertical holding chamber. This vessel, however, is open at the top to the atmosphere and is unsuitable for pouring treated ductile iron since atmospheric exposure depletes the magnesium content of the iron. A similar known pouring system uses the same type of vertical pouring vessel but is fitted with a horizontal coreless inductor extending from a side of vessel and forming an auxiliary horizontal heating chamber into which metal is withdrawn from the main chamber of the vessel for heating before being returned to the main chamber. This vessel is also open to the atmosphere at the top and as such is not suitable for pouring treated ductile iron. Furthermore, this system is not known to be successful in pouring treated ductile iron since the inductor tends to plug with deposits, like the cored induction heater. Its known usage has been limited to nonferrous applications.

The U.S. Pat. No. 5,056,692 to Wilford et al., granted Oct. 15, 1991, discloses still another alternative whereby a horizontal flow-through bottom poured vessel is equipped with a vertical tower coupled to a vacuum for withdrawing molten metal from the vessel upwardly into the tower to establish a metal pressure head. Vertically extending coreless induction coils surround the tower for heating the metal during downtimes or pour stoppages. This type of induction heater, however, detracts from the inherent flow-through pouring capability of the vessel by requiring metal to be withdrawn from the vessel for heating prior to pouring. Metal thus can not be heated simultaneously with the pouring of the metal.

Coreless induction heaters have found many applications in various industries, including incorporation in an induction melting furnace developed previously by William J. Duca, one of the inventors herein, forming the subject matter of U.S. Pat. No. 3,602,625, granted Aug. 31, 1971. This furnace includes a U-shaped chamber and a surrounding coreless induction heating coil for melting and heating the metal as it flows through the chamber. Such a furnace, however, is limited to melting and heating metal and is not suited for dispensing metal into molds.

In the metal casting industry, melting and pouring are considered and treated as separate, nonanalogous arts. This is evidenced by the fact that for over 20 years nobody in either industry, including Duca himself, thought to use an induction heater like that disclosed in the Duca '625 patent in combination with a pouring vessel as a means of possibly overcoming the plugging problems associated with pouring treated ductile iron through an induction heated vessel. In fact, during this 20 year time period, much of Duca's efforts involved redesigning existing channel-type inductors to accommodate treated ductile iron.

It was not until the joint inventors herein collaborated that they discovered using an induction heater of the type previously developed by Duca for melting furnace applications in combination with a modified existing flow-through pouring vessel as a means of solving the plugging problems associated with pouring treated ductile iron without interfering with the continuous pouring cycle of the vessel.

SUMMARY OF THE INVENTION AND ADVANTAGES

A metal casting apparatus for pouring molten metal into a mold to produce a casting comprises a metal pouring vessel having a generally horizontally disposed main body chamber provided with an inlet at one end thereof for admitting molten metal into the chamber and an outlet spaced from the inlet at an opposite end thereof for discharging molten metal from the chamber and into the mold. The apparatus includes valve means movable with respect to the outlet for regulating the discharge of molten metal and is characterized by induction heating means surrounding the chamber for electromagnetically heating the metal within the chamber simultaneously with the operation of the valve means.

The invention thus provides a metal pouring apparatus capable of continuously heating metal, including treated ductile iron, while simultaneously pouring the metal into molds. The simultaneous heating/pouring capability advantageously allows molten metal to be introduced at lower temperatures than would be permitted for unheated vessels. Below-temperature metal may be heated to proper pouring temperature as it flows through the induction heated main body chamber before exiting the vessel.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1 is a perspective view of the automated pouring system;

FIG. 3 is a transverse cross-sectional view of the pouring vessel.

DETAILED DESCRIPTION OF THE DRAWINGS

Figure 2:
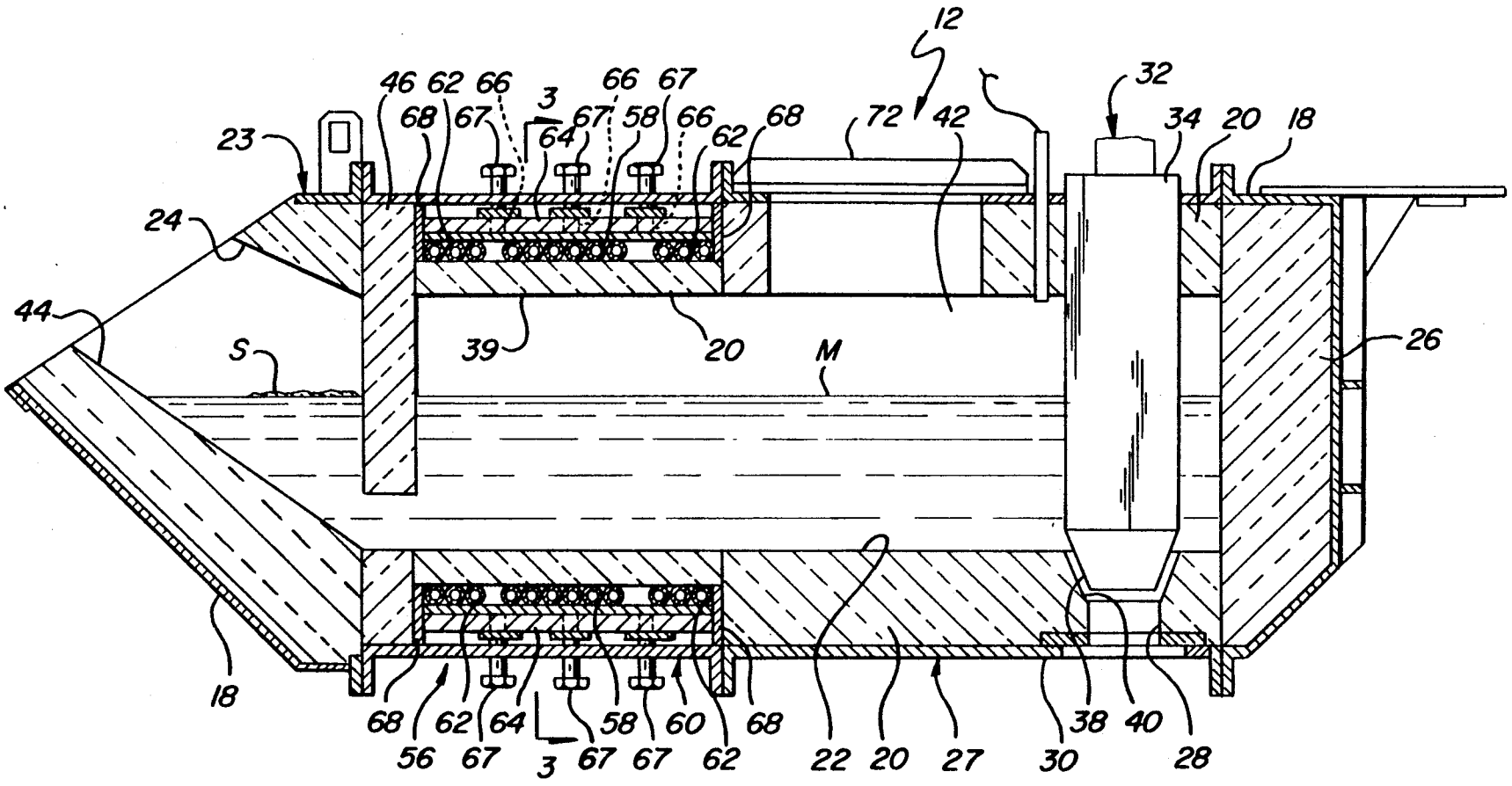
FIG. 2 is a longitudinal cross-sectional view of the pouring vessel.

An automated metal pouring system is shown generally at 10 in FIG. 1 and comprises a pouring vessel 12 supported by a moveable carriage 14 above a continuous moving mold line, generally indicated at 16. The vessel 12 may be suitably adapted for pouring any metal or alloy, but is particularly useful in ferrous metallurgy for pouring cast iron, including treated ductile iron and a gray iron.

The pouring vessel 12 includes a metal housing or shell 18 lined with a refractory liner 20 forming a generally horizontal main body chamber 22 extending lengthwise between opposite ends. The vessel 12 has a metal charging section 23 defining an inlet 24 for admitting molten metal M into the chamber 22. The opposite end of the chamber 22 is closed by a vertical end wall 26. The vessel also includes a separate pouring section 27 provided with an outlet or nozzle 28 in a bottom wall 30 of the vessel 12 at the opposite end adjacent wall 26 for discharging the metal 26 from the chamber 22 into underlying casting molds C of mold line 16. The nozzle 28 comprises an opening or aperture in the bottom of the vessel 12 extending through the housing 18 and refractory 20 to serve as an outlet for the metal M.

Valve means, such as an automated stopper rod mechanism 32, is provided and moveable with respect to the nozzle 28 for regulating the flow of molten through the nozzle 28. The stopper rod mechanism 32 comprises a generally cylindrical stopper rod 34 supported for vertical movement by an automated stopper control mechanism 36 and extending into the chamber 22 of the pouring section 27 through a top wall 39 of the vessel 12. The free end of the stopper rod 34 and the nozzle 28 are provided with complementary conical seating surfaces 38, 40, respectively, which, when engaged, prevent metal from flowing through the nozzle 28. The control mechanism 36 is commercially available from CMI Equipment and Engineering, 533 North Court Street, AuGres, MI 48703.

The chamber 22 is designed to be only partially filled with metal and preferably operates between 25–70% full. Thus, at any given time, there is an air space 42 above the top surface of the metal M and the chamber 22. A lower lip 44 of the inlet opening 24 is spaced below the upper wall of the chamber 22 preventing overfilling of the chamber 22.

Partition means in the preferred form of an inlet baffle 46 extends downwardly into the chamber 22 adjacent the inlet opening 24 for immersion in the metal M. The baffle 46 closes off the air space 42 from the atmosphere and prevents any slag or other floating impurities S which may be present in the metal charged into the inlet opening 24 from entering the chamber 22 by requiring that metal pass beneath the submerged free end of the baffle 46 prior to entering the chamber 22.

The pouring vessel 12 may also include inert atmosphere means 48 communicating with the chamber 22 for providing an inert atmosphere, such as argon, to the space 42 over the metal in the chamber 22. The inert atmosphere means 48 may comprise a lance 50 extending into the chamber 22 and connected to a source of inert atmosphere 54 by line 52. The inert atmosphere is particularly advantageous when pouring treated ductile iron inoculated with magnesium since exposure to the atmosphere causes magnesium loss.

The pouring ladle 12 is further provided with induction heating means 56 surrounding the chamber 22 for electromagnetically heating the metal within the chamber 22 simultaneously with the operation of the stopper rod mechanism 32 to enable continuous heating and pouring of the metal. The heating means 56 includes a coreless induction heating coil 58 wound around the refractory lining 20 of the chamber 22 so as to extend horizontally and coaxially with the chamber 22 forming an induction heating zone or section 60 of the chamber 22 between and separating the charging and pouring sections 23, 27 and through which all metal introduced into the chamber 22 must pass before discharge through the nozzle 28. In this way, metal can be heated without requiring the metal to be drawn out of the chamber 22 or diverted from its natural flow path between the inlet 24 to the nozzle 28, thereby enabling the induction heater 56 to be operated simultaneously with the operation of the stopper rod mechanism 32. The heating section 60 of the chamber 22 is circular in cross-section, as best seen in FIG. 3.

The heating coil 58 comprises a tubular electrical conductor in the preferred form of copper tubing supported outside of the chamber 22 by the refractory liner 20. The copper tubing 58 is connected to a source of electrical energy (not shown) for passing alternating electric current through the walls of the tubing to generate electromagnetic induction heat in the metal. Water is circulated through the tubing 58 to cool the coils 58 during operation.

Adjacent each end of the heating coil 58 is a tubular cooling coil 62. The coils 62 are fabricated of a high resistance material to discourage inductive heating of the coils 62 and are also water cooled to prevent conductive heating of the vessel 12. The cooling coils 62 are not connected to the source of energy supply.

The heating means 56 also includes a shunt 64 surrounding the coils 58 and 62. The shunt 64 is fabricated of laminated sheets of silicon steel of low reluctance for acting as a low energy return path for the magnetic flux generated by the heating coil 58 thereby allowing the metal in the chamber 22 to become heated by the electromagnetic energy but not the metal housing 18. A plurality of circumferentially spaced clamping yokes 66 are secured to the metal housing 18 by bolts 67 and are adjustable radially inwardly for clamping the shunt 64 securely in place about the coils 58, 62. The heating means 56 also includes a pair of flux diverters 68 adjacent the opposite axially ends of the shunt 64 and coils 58, 62 for diverting the flux of the heating coil 58 into the shunt 64. The flux diverters 68 are preferably fabricated from aluminum and serve also as a mechanical device for positioning and locking the coils 58, 62 in place. A removable service cover 72 is also provided for gaining access to the chamber 22.

The pouring system 10 operates by introducing molten metal into the ladle 12 from a molten metal charging hopper 70 (FIG. 1). When pouring certain grades of metal, such as treated ductile iron, it may also be desirable to introduce an inert atmosphere into the chamber 22 via the lance 50. The inlet baffle 46 seals the chamber 22 and prevents the metal in the chamber 22 from being exposed to the outside atmosphere.

As metal is poured into the ladle 12 through the inlet 24, metal is simultaneously discharged into the underlying molds 30 through the bottom nozzle 28 by operating the stopper rod mechanism 32. The ladle carriage 14 shuttles the ladle 12 with reciprocating motion along the mold line 16 for near continuous pouring of the molds.

All metal introduced into the vessel 12 must pass through the induction heating zone 60 before being discharged through the nozzle 28. Because the induction heater 56 surrounds the pouring chamber 22, there is no need to draw the metal into a separate zone or chamber for heating, which would interrupt the continuous operation of the pouring vessel 12. Rather, the induction heating coil arrangement of this invention allows for the continuous flow-through operation of the pouring vessel 12 simultaneously with the heating of the metal. The amount of heating required will depend on the amount and temperature of the metal in the chamber 22. A control system (not shown) may be provided to regulate the current applied to the heating coil 58 to control heating of the metal.

When the temperature of the metal poured into the vessel 12 is at or above the desired pouring temperature, the induction heater 56 operates on very low power and serves to maintain the temperature of the metal before discharge through the nozzle 28. If, however, the charged metal is below the minimum allowable pouring temperature, the power to the induction heater 56 is increased to heat the metal to an acceptable temperature before discharge without interrupting the pouring cycle. In this manner, the induction heater 56 enables precise, fine tuning of the metal temperature before discharge through the nozzle 28.

The magnetic field produced by the heating coil 58 forces the metal within the confines of the coil 58 radially inwardly toward the center of the coil. These forces produce an electromagnetic pinch effect which acts to squeeze the metal within the coil 58 and forms a central depression or well in the surface of the metal within the heating zone 60 as seen in FIG. 3. The well advantageously captures any slag or other floating impurities and traps them within the heating zone 60 to prevent their discharge through the nozzle 28. The well thus advantageously cleans the metal as it flows through the chamber 22 thereby producing a cleaner cast product.

The pouring vessel 12 may be lifted free from the carriage 14 and tilted to rapidly empty the ladle 12 of metal through the inlet opening 24. The ability to totally and rapidly empty the vessel 12 allows for frequent alloy changes.

The invention has been described in an illustrative manner and it is to be understood that the terminology with has been used is intended to be in the nature of words of description rather than of limitation.

Obviously many modifications and variations of the present invention are possible in light of the above teachings. It is, therefore, to be understood that within the scope of the appended claims wherein reference numerals are merely for convenience and are not to be in any way limiting. The invention may be practiced otherwise than as specifically described.

What is claimed:

1. A metal pouring apparatus suitable for pouring molten magnesium-treated iron metal into a mold to produce a casting, said apparatus comprising:

a metal pouring vessel (12) including a generally horizontally disposed main body chamber (22) having an inlet (24) at one end thereof for admitting molten metal into said chamber (22) and a bottom outlet (28) spaced from said inlet (24) at an opposite end thereof for discharging molten metal from said chamber (22) into the underlying mold;

valve means (32) moveable with respect to said outlet (28) for regulating the discharge of molten metal;

and induction heating means (56) surrounding said chamber (22) for electromagnetically heating the metal within said chamber (22) simultaneously with the operation of said valve means (32).

2. An apparatus as set forth in claim 1 wherein said induction heating means (56) comprises a coreless induction heating coil (58) wrapped about said chamber (22) forming an induction heating zone (60) through which the molten metal must pass before discharging through said outlet (28).

3. An apparatus as set forth in claim 2 wherein said induction heating means (56) includes a pair of cooling coils (62) on opposite ends of said heating coil (58).

4. An apparatus as st forth in claim 3 wherein said induction heating means (56) includes a shunt (64) disposed about said heating coil (58) and said cooling coils (62).

5. An apparatus as set forth in claim 4 wherein said induction heating means (56) includes a pair of flux diverters (68) disposed adjacent each of said cooling coils (62).

6. An apparatus as set forth in claim 2 wherein said outlet (28) comprises a nozzle (28) disposed in a bottom wall of said vessel (12) and said valve means (32) comprises a stopper rod mechanism (32).

7. An apparatus as set forth in claim 2 wherein said vessel (12) includes partition means (46) adjacent said inlet (24) and extending downwardly from an upper wall of said chamber (22) for immersion in the metal for preventing slag and other floating impurities which may be present in the metal from entering said chamber (22).

8. An apparatus as set forth in claim 7 wherein said partition means (46) comprises an inlet baffle (46) closing off said chamber (22) from the external atmosphere.

9. An apparatus as set forth in claim 8 including inert atmosphere means (48) communicating with said chamber (22) for providing an inert atmosphere to the metal in said chamber (22).

10. An apparatus as set forth in claim 2 wherein said heating zone (60) is generally circular in cross section.

* * * * *